US006154898A

United States Patent [19]

Ball

[11] Patent Number: 6,154,898

[45] Date of Patent: Dec. 5, 2000

[54] WASTEWATER DRAIN CONTROL FOR FLUID COMPARTMENTS

[75] Inventor: William T. Ball, Leawood, Kans.

[73] Assignee: WCM Industries, Inc., Colorado Springs, Colo.

[21] Appl. No.: 09/314,352

[22] Filed: May 19, 1999

[51] Int. Cl.[7] ..... E03C 1/232

[52] U.S. Cl. ..... 4/684; 4/292; 4/688; 4/689; 4/691; 4/692; 4/286

[58] Field of Search ..... 4/682, 683, 684, 4/685, 686, 687, 688, 689, 690, 691, 692, 693, 650, 653, 286, 287, 289, 290, 292, 293, 295, DIG. 14, 613; 210/163, 164, 165, 166; 137/449; 251/229, 231, 319, 242–245, 247, 356

[56] References Cited

U.S. PATENT DOCUMENTS

| | | | |
|---|---|---|---|
| 13,677 | 10/1855 | Fuller | 251/356 |
| 130,885 | 8/1872 | Whitwell . | |
| 641,028 | 1/1900 | Meehan . | |
| 782,860 | 2/1905 | Lever . | |
| 951,795 | 3/1910 | Anger . | |
| 1,227,037 | 5/1917 | Chase | 137/449 |
| 1,593,087 | 7/1926 | Logan . | |
| 1,857,054 | 5/1932 | Luppes . | |
| 2,855,944 | 10/1958 | Albin | 137/449 |
| 3,010,118 | 11/1961 | Isherwood . | |
| 3,314,085 | 4/1967 | Minella . | |
| 4,596,057 | 6/1986 | Ohta et al. | 4/292 |
| 4,969,217 | 11/1990 | Gandini | 4/200 |
| 5,050,247 | 9/1991 | Hsu | 4/203 |
| 5,290,008 | 3/1994 | Young | 251/247 |
| 5,363,518 | 11/1994 | Mowery | 4/692 |
| 5,509,150 | 4/1996 | Bergmann et al. | 4/691 |
| 6,023,795 | 2/2000 | Potter et al. | 4/292 |

FOREIGN PATENT DOCUMENTS

| | | | |
|---|---|---|---|
| 695150 | 12/1930 | France | 4/689 |
| 1192782 | 10/1959 | France | 4/688 |

*Primary Examiner*—Henry J. Recla
*Assistant Examiner*—Khoa D. Huynh
*Attorney, Agent, or Firm*—Zarley, McKee, Thomte, Voorhees & Sease

[57] ABSTRACT

A wastewater drain control for fluid compartments has a waste water discharge port in the bottom thereof and in communication with a vertical drain pipe. A valve seat element is in the pipe below the port and has an inclined annular valve seat surface and a center opening. A spherical valve element has a diameter greater than the center opening in the valve seat surface and is adapted to close the center opening to fluid flow when dwelling on the valve seat element above the center opening. A valve stem is rigidly secured by an upper end to the spherical valve element. The lower end extends downwardly through the center opening and terminates in a lower end. This lower end is connected to a linkage assembly which extends through a seal element in the vertical pipe and extends to a remote location accessible in the environment of the fluid compartment. Operation of the linkage moves the valve stem and the spherical valve upwardly or downwardly to engage the spherical valve element into or out of contact with the valve seat surface to open or close the fluid flow through the center opening. A strainer element extends across the port in the bottom of the fluid compartment to prevent large particulate matter to flow into the drain pipe. The strainer is held in place by a plurality of resilient vertical rods which extend downwardly from the strainer for engagement in an annular groove within the drain pipe.

2 Claims, 2 Drawing Sheets

WASTEWATER DRAIN CONTROL FOR FLUID COMPARTMENTS

BACKGROUND OF THE INVENTION

Drain closures for kitchen sinks and the like assume a plurality of designs and have long been in use. They sometimes are comprised of removable components, and others utilize manually raised and lowered valves or such valves connected to appropriate linkage for remote operation.

Many of the prior art drain closure devices are expensive to manufacture and/or to install, and many do not create long term closure to the drain passageway after extensive usage. Others are not easily cleaned or accessible for repair and maintenance.

It is therefore a principal object of this invention to provide a water drain control for fluid compartments which is inexpensive of manufacture, and highly efficient in its use and operation. A further object of this invention is to provide a wastewater drain control for fluid compartments wherein easy access is available to the valve closure element therein.

These and other objects will be apparent to those skilled in the art.

SUMMARY OF THE INVENTION

A wastewater drain control for fluid compartments has a waste water discharge port in the bottom thereof and in communication with a vertical drain pipe. A valve seat element is in the pipe below the port and has an inclined annular valve seat surface and a center opening.

A spherical valve element has a diameter greater than the center opening in the valve seat surface and is adapted to close the center opening to fluid flow when dwelling on the valve seat element above the center opening. A valve stem is rigidly secured by an upper end to the spherical valve element. The lower end extends downwardly through the center opening and terminates in a lower end. This lower end is connected to a linkage assembly which extends through a seal element in the vertical pipe and extends to a remote location accessible in the environment of the fluid compartment. Operation of the linkage moves the valve stem and the spherical valve upwardly or downwardly to engage the spherical valve element into or out of contact with the valve seat surface to open or close the fluid flow through the center opening.

A strainer element extends across the port in the bottom of the fluid compartment to prevent large particulate matter to flow into the drain pipe. The strainer is held in place by a plurality of resilient vertical rods which extend downwardly from the strainer for engagement in an annular groove within the drain pipe.

DESCRIPTION OF THE PREFERRED EMBODIMENT

Figure 1:
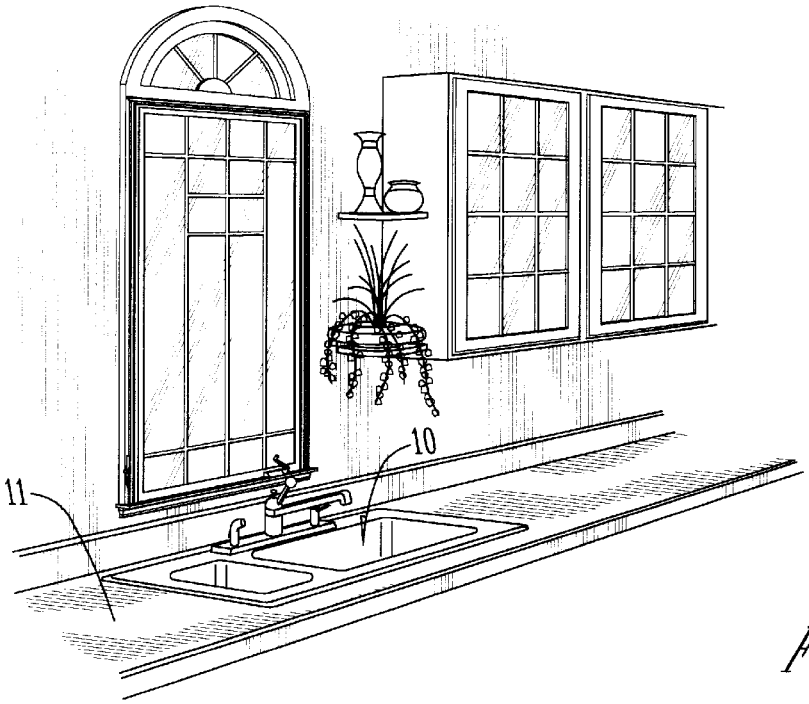
FIG. 1 is a perspective view of a conventional kitchen counter with a fluid compartment or sink mounted therein.

A fluid compartment or sink 10 is conventionally mounted in counter top 11 as best shown in FIG. 1. Compartment 10 has a top 12, a sidewall 14, and a bottom 16, all of which are of conventional construction. A conventional water control 18 is associated with a source of water (not shown) for conventional use of the compartment 10.

Figure 2:
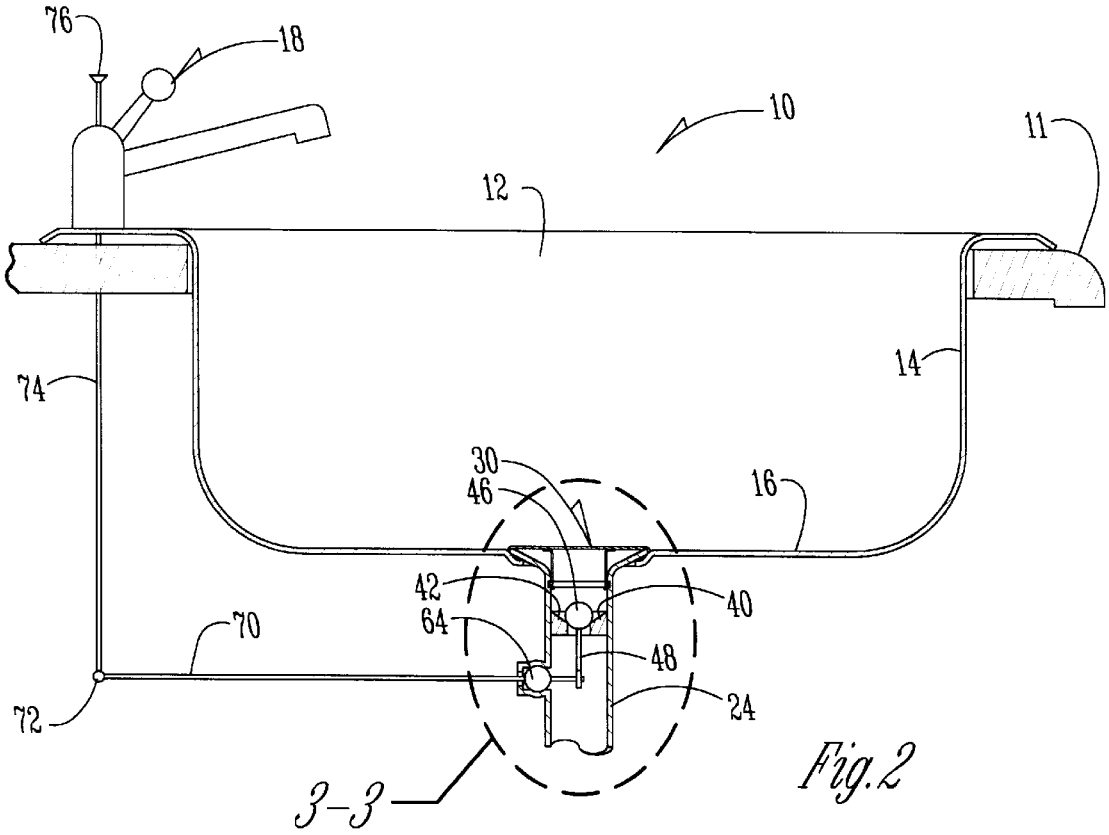
FIG. 2 is an enlarged scale sectional view through the fluid compartment of FIG. 1.
Figure 3:
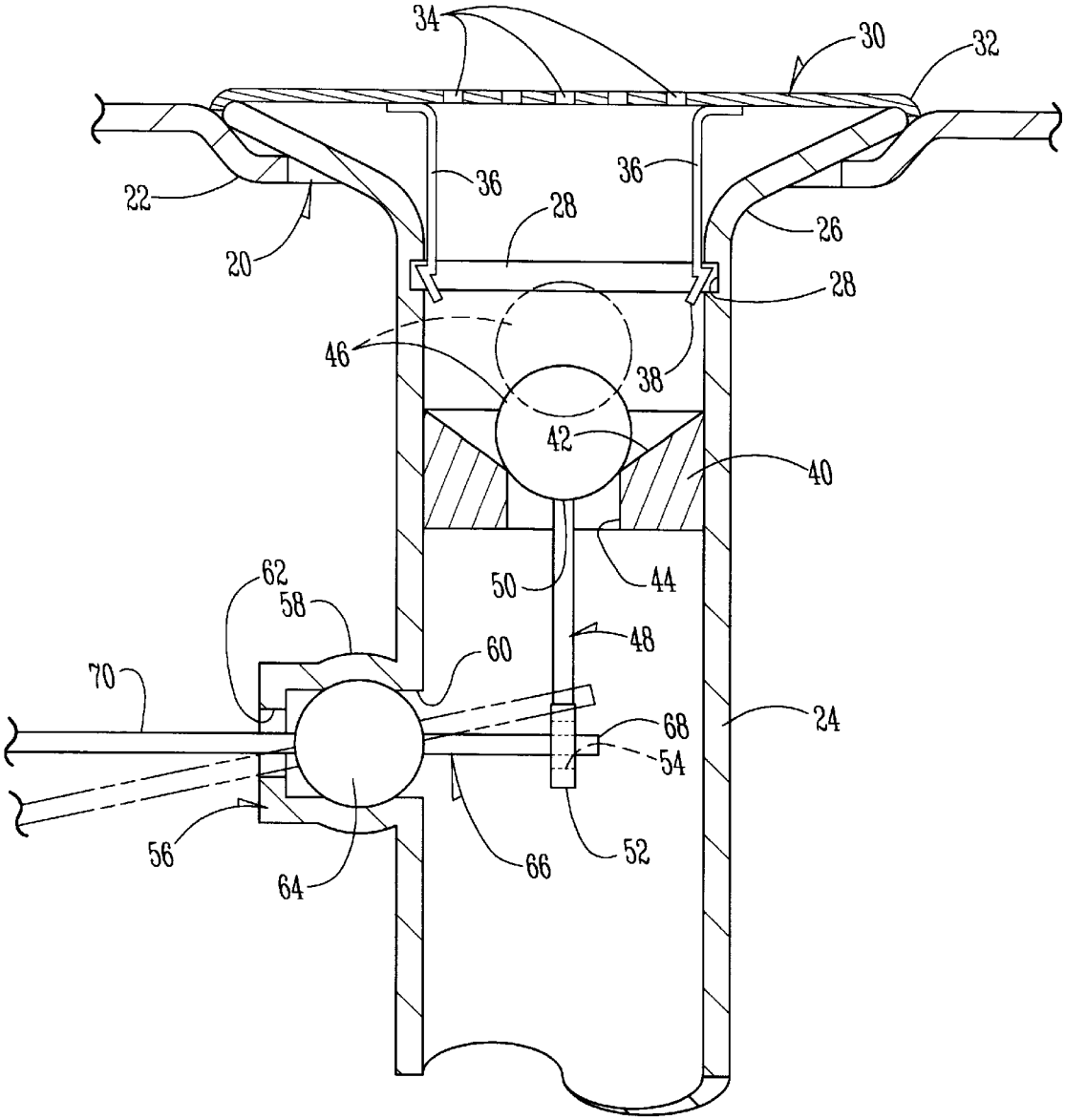
FIG. 3 is an enlarged scale partial sectional view taken on line 3—3 of FIG. 1.

As shown in FIGS. 2 and 3, a conventional opening or port 20 is located in the bottom 16 of the compartment 10. Port 20 is surrounded by recessed flange 22 (FIG. 3). A vertical wastewater drain pipe 24 has an upwardly and outwardly external flange 26 at its upper end which nests within the port 20 and the recessed flange 22. An annular groove 28 is formed in the interior surface of pipe 24 in a horizontal plane just below the flange 26. A conventional strainer 30 with a downwardly extending peripheral flange 32 and center apertures 34 is mounted on the upper periphery of flange 26. Resilient rods 36 are secured by their upper ends to the lower surface of strainer 30 and extend downwardly therefrom. Barbs 38 are formed on the lower end of rods 36. The barbs 38 are adapted to be moved by the resilient nature of rods 36 into the annular groove 28 to retain the strainer in position over the port 20.

A valve seat element 40 (FIG. 3) has a sloping or tapered valve seat surface 42 and a smaller center opening 44 through which fluid is adapted to move from the compartment 10 through pipe 24 at times. A spherical valve 46 is adapted to rest on the valve seat surface 42 at times and covers the center opening 44 when fluid flow is prohibited (FIG. 3). It is seen from the drawings that the diameter of valve element 46 is greater than the diameter of the center opening 44. A rigid stem 48 has its upper end 50 rigidly secured to the valve element 46. The lower end 52 of stem 48 has an elongated slot 54 formed therein.

As best shown in FIG. 3, a linkage port 56 is formed in one side of pipe 24 and has a convex portion 58 formed therein. The linkage port 56 is in communication with the interior of pipe 24 by means of an opening 60 therein. A second opening 62 is formed in the linkage port 56 opposite to opening 60. A spherical seal and bearing element 64 is rotatably mounted in linkage port 56 within the confines of the convex portion 58. A rod 66 extends through member 64 and has an inner end 68 which penetrates into the interior of pipe 24 and extends through slot 54 in the lower end of stem 48.

The outer end 70 of rod 66 protrudes through opening 62 in the port 56 and terminates at pivot member 72. A vertical link member 74 has a lower end also connected to pivot 72 and terminates in handle 76 which is located in the vicinity of water control 18.

It should be noted that spherical seal and bearing 64 serve to seal the linkage port 56 against any leakage of wastewater in pipe 24 from migrating outwardly through opening 62 in the linkage port.

In operation, the valve element 46 is in its closed position as shown in FIGS. 2 and 3 wherein the handle 76 on the linkage rod 74 is in its upper position. To open the valve seat element 40 for fluid flow to drain wastewater from compartment 10, the operator will push handle 76 in a downwardly direction which will cause the rod 70 to move to the position of the dotted lines in FIG. 3. This will cause the inner end 66 of rod 70 to bear upwardly on the upper end of slot 54, and thence raise stem 48 in an upwardly direction which will move valve element 46 to the position shown in the dotted lines of 53. By disengaging the valve element 46 from the valve seat 40, fluid will flow through the center opening 44.

The closure in the drain pipe 24 is easy to operate, easily accessible, and will endure for long periods of operation.

The detachable strainer 30 serves to provide access to element 46 for replacement or repair. A narrow elongated tool is inserted through one of the apertures 34 to move the barbs 38 on rods 36 out of engagement with annular groove 28.

It is therefore seen that this invention will achieve its stated objectives.

What is claimed is:

1. A wastewater drain control for fluid compartments, comprising, a fluid compartment having an open top, sidewalls, and a bottom, a wastewater discharge port in the bottom in communication with a vertical pipe that has an inner diameter, a valve seat element in the pipe below the port having an inclined annular valve seat surface and a center opening, a spherical valve element having a diameter greater than the center opening in the valve seat surface and adapted to close the center opening to fluid flow when dwelling on the inclined annular valve seat surface above the center opening, a valve stem rigidly secured by an upper end to the spherical valve element and extending downwardly through the center opening and terminating in a lower end, linkage connected to the lower end of the valve stem and extending laterally outwardly through the pipe to an operating position above and adjacent the fluid compartment to raise and lower the spherical valve element with respect to the valve seat element and the center opening therein to open and close, respectively, fluid flow downwardly through the center opening in the valve seat element, a drainer strainer is located over the discharge port in the fluid compartment, wherein the strainer is mounted on top of the pipe, and an annular groove is formed in the inner diameter of the pipe adjacent the port, a plurality of elongated resilient rods extend downwardly from the strainer and terminate in a barb that engages the annular groove.

2. The device of claim 1 wherein the linkage extends through a movable fluid-tight bearing in the pipe.

* * * * *